US012778276B2

(12) United States Patent
De Wit et al.

(10) Patent No.: US 12,778,276 B2
(45) Date of Patent: Nov. 3, 2026

(54) BRUSH FOR USE IN A CLEANING DEVICE FOR CLEANING SURFACES

(71) Applicant: KONINKLIJKE PHILIPS N.V., Eindhoven (NL)

(72) Inventors: Bastiaan Johannes De Wit, Eindhoven (NL); Anke Rieka Meulendijks, Eindhoven (NL); Jamila Midhat, Eindhoven (NL); Orhan Kahya, Eindhoven (NL); Chengang Cao, Eindhoven (NL); Rinse Hendrik Bosma, Eindhoven (NL); Fermín Espín Franco, Eindhoven (NL); Robert Friso Burgers, Eindhoven (NL); Albert Al-Shorachi, Eindhoven (NL); Arjan Sander Vonk, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 558 days.

(21) Appl. No.: 18/268,209

(22) PCT Filed: Sep. 30, 2021

(86) PCT No.: PCT/EP2021/076954
§ 371 (c)(1),
(2) Date: Jun. 16, 2023

(87) PCT Pub. No.: WO2022/069638
PCT Pub. Date: Apr. 7, 2022

(65) Prior Publication Data

US 2024/0065428 A1 Feb. 29, 2024

(30) Foreign Application Priority Data

Oct. 1, 2020 (EP) ..... 20199548

(51) Int. Cl.
*A46B 13/00* (2006.01)
*A46B 13/02* (2006.01)
(Continued)

(52) U.S. Cl.
CPC ..... *A46B 13/001* (2013.01); *A46B 13/02* (2013.01); *A47L 9/0477* (2013.01); *A47L 11/282* (2013.01);
(Continued)

(58) Field of Classification Search
CPC ..... A47L 13/001; A47L 13/006; A47L 13/02; A47L 13/04; A47L 11/4041;
(Continued)

(56) References Cited

U.S. PATENT DOCUMENTS 4,706,320 A 11/1987 Swift
5,515,568 A 5/1996 Larson et al.
(Continued)

FOREIGN PATENT DOCUMENTS

CN 101143362 A 3/2008
CN 102247110 A 11/2011
(Continued)

OTHER PUBLICATIONS

Extended European Search Report issued in connection with corresponding EP Application No. 20199548.7 dated Mar. 3, 2021.

*Primary Examiner* — Laura C Guidotti
(74) *Attorney, Agent, or Firm* — Maschoff Brennan

(57) ABSTRACT

A brush, rotatably arranged in a cleaning device for cleaning surfaces, is described. The brush includes a core element and brush elements arranged on the core element. The brush elements are arranged in a bristle field extending in a direction of a longitudinal axis of the brush and in a peripheral direction about the longitudinal axis. Further, the brush elements include fiber hairs. Furthermore, a linear
(Continued)

mass density of at least tip portions of the brush elements is lower than 15 g per 10 km. In addition, an average of a packing density of the brush elements in the bristle field is lower than 15,000 brush elements per 1 $cm^2$ so as to ensure that for the purpose of moving the brush during a cleaning action, only a relatively small amount of energy is needed.

18 Claims, 3 Drawing Sheets

(51) Int. Cl.
*A47L 9/04* (2006.01)
*A47L 11/282* (2006.01)
*A47L 11/40* (2006.01)

(52) U.S. Cl.
CPC ..... *A47L 11/4041* (2013.01); *A47L 11/4088* (2013.01)

(58) Field of Classification Search
CPC .. A47L 9/0477; A47L 11/282; A47L 11/4036; A47L 11/28; A47L 9/0466; A47L 9/0461; A47L 9/04; A46B 13/001; A46B 13/006
See application file for complete search history.

(56) References Cited

U.S. PATENT DOCUMENTS

| | | | | |
|---|---|---|---|---|
| 7,806,986 | B2 * | 10/2010 | Ueebisu | B08B 1/00 134/32 |
| 8,555,446 | B2 * | 10/2013 | Moes | A47L 11/4088 15/52.1 |
| 8,782,851 | B2 * | 7/2014 | Follows | A47L 9/0477 15/207.2 |
| 10,349,796 | B2 | 7/2019 | De Wit et al. | |
| 2005/0125941 | A1 | 6/2005 | Joung et al. | |
| 2010/0107357 | A1 | 5/2010 | Odachi et al. | |

FOREIGN PATENT DOCUMENTS

| | | | | |
|---|---|---|---|---|
| CN | 104114292 | A | 10/2014 | |
| CN | 105149533 | A | 12/2015 | |
| CN | 209826554 | U | 12/2019 | |
| DE | 112018000186 | T5 | 9/2019 | |
| JP | 6219730 | B2 | 10/2017 | |
| RU | 2647449 | C2 | 3/2018 | |
| WO | 2010041184 | A1 | 4/2010 | |
| WO | 2013027140 | A1 | 2/2013 | |
| WO | WO 2020/090001 | A1 * | 5/2020 | A47L 9/04 |

* cited by examiner

Fig. 1
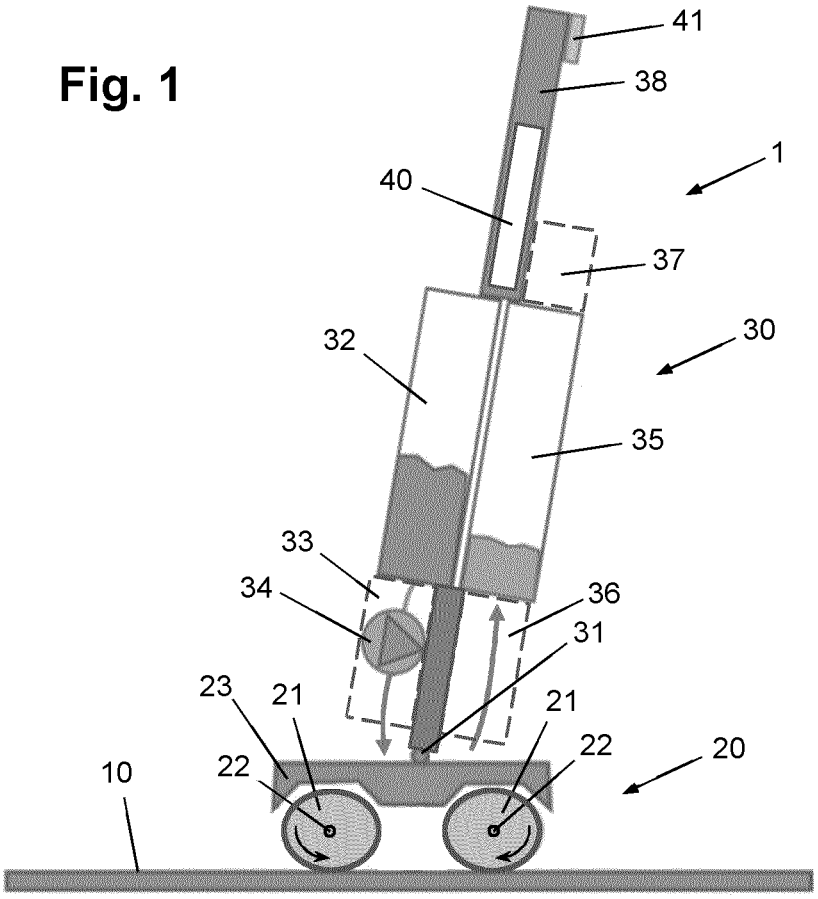
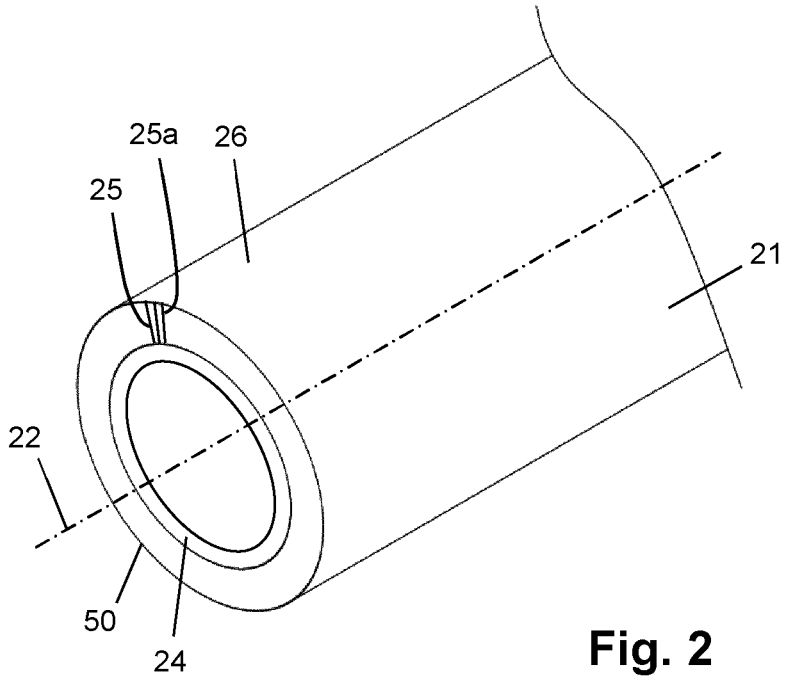
Fig. 2

BRUSH FOR USE IN A CLEANING DEVICE FOR CLEANING SURFACES

CROSS-REFERENCE TO RELATED APPLICATIONS

The present application is a U.S. National Phase application under 35 U.S.C. § 371 of International Application No. PCT/EP2021/076954, filed on Sep. 30, 2021, which claims the benefit of European Patent Application No. 20199548.7, filed on Oct. 1, 2020. These applications are hereby incorporated by reference herein.

FIELD OF THE INVENTION

The invention relates to a brush which is configured to be rotatably arranged in a cleaning device which is movable across surfaces for cleaning the surfaces, at the position of a functional head of the cleaning device which is configured to face the surfaces to be cleaned, the brush comprising a core element and brush elements arranged on the core element, wherein tip portions of the brush elements are configured to contact the surfaces to be cleaned, wherein the brush elements are arranged in a bristle field extending in a direction of a longitudinal axis of the brush and in a peripheral direction about the longitudinal axis, and wherein the brush elements comprise fiber hairs.

Further, the invention relates to a cleaning device which is movable across surfaces for cleaning the surfaces, comprising a functional head configured to face the surfaces to be cleaned and at least one brush as mentioned rotatably arranged in the functional head about a rotation axis extending in the direction of the longitudinal axis of the brush.

BACKGROUND OF THE INVENTION

WO 2010/041184 A1 relates to a cleaning device for cleaning a surface, which comprises at least one brush which is rotatable in a rotation direction and movable over a surface to be cleaned, whereby the at least one brush is effective in loosening and removing dirt from the surface during operation of the cleaning device. The cleaning device is suitable for cleaning with or without a cleaning liquid. In view of the first option, the cleaning device comprises a wetting system for supplying the cleaning liquid to the at least one brush. In case a user of the cleaning device desires to perform a wet cleaning action by means of the cleaning device, the wetting system is activated to supply the cleaning liquid to the at least one brush. As a result, the surface to be cleaned is wetted by means of the at least one brush, and the at least one brush also acts to remove the cleaning liquid from the surface to be cleaned, together with the dirt.

In the field of cleaning devices such as the cleaning device known from WO 2010/041184 A1, it is an ongoing trend to have cordless cleaning devices, particularly cleaning devices comprising a rechargeable battery arrangement. In view thereof, it is an object of the invention to provide a way of reducing the amount of electric energy that is needed during operation of a cleaning device, so that runtime of the cleaning device, i.e. the total time that the cleaning device can be operated on a fully charged battery arrangement before the battery arrangement runs out, can be prolonged.

SUMMARY OF THE INVENTION

The invention provides a brush which is configured to be rotatably arranged in a cleaning device which is movable across surfaces for cleaning the surfaces, at the position of a functional head of the cleaning device which is configured to face the surfaces to be cleaned, and which comprises a core element and brush elements arranged on the core element, wherein tip portions of the brush elements are configured to contact the surfaces to be cleaned, wherein the brush elements are arranged in a bristle field extending in a direction of a longitudinal axis of the brush and in a peripheral direction about the longitudinal axis, wherein the brush elements comprise fiber hairs, wherein a linear mass density of at least the tip portions of the brush elements is lower than 15 g per 10 km, and wherein an average of a packing density of the brush elements in the bristle field is lower than 15,000 brush elements per 1 $cm^2$.

The invention is applicable in the context of cleaning any type of surface, including soft floor surfaces such as floor surfaces with carpets and hard floor surfaces such as floor surfaces with tiles. The brush according to the invention is of the type in which the brush elements comprise fiber hairs, wherein a linear mass density of at least the tip portions of the brush elements is lower than 15 g per 10 km. The linear mass density is also referred to as Dtex value. In the brush according to the invention, at least the tip portions of the brush elements are flexible, and preferably the brush elements are entirely flexible so that they can easily bend under the influence of contact to a surface. The Dtex value of at least the tip portions of the brush elements can have an even lower upper limit such as 10 g per 10 km, 5 g per km or 1 g per 10 km. For the sake of completeness, it is noted that the phrase "at least the tip portions of the brush elements" is to be understood so as to include the option of the brush elements in their entirety or near-entirety.

A brush which is of the type in which the brush elements comprise fiber hairs, as mentioned, is known to be very effective when it comes to performing cleaning actions, especially wet cleaning actions. The brush can be rotated at such a speed that the tip portions of the brush elements are accelerated to such an extent the moment they move out of contact from a surface to be cleaned that any dirt and/or liquid picked up from the surface is flung away and cannot reach the surface anymore, assuming that a suitable system is provided for receiving and retaining the dirt and/or liquid, probably transporting the dirt and/or liquid further away from the surface. A suitable value of the acceleration as mentioned is a value of at least 3,500 $m/s^2$, preferably a value of at least 7,000 m/s 2 or even 12,000 $m/s^2$. An insight underlying the invention is that in a cleaning device comprising at least one brush which is to be put in cleaning contact with the surfaces to be cleaned and to be moved over those surfaces, reduction of energy consumption is possible by adapting the design of the brush. In particular, in the context of a cleaning device equipped with a brush which is rotated during operation of the cleaning device, the applicant has found a relation between packing density of the brush elements and energy needed for moving the brush, according to which less energy is needed when the packing density of the brush elements is reduced. In view of the very low Dtex value of at least the tip portions of the brush elements, this does not have to do with a reduction of friction at the position of contact to the surfaces to be cleaned, to mention an effect that could be expected in other contexts, and the relation as mentioned is therefore unexpected. The applicant has gained the insight that when the brush is rotated, an air-pumping effect of the brush is obtained, and that the air-pumping effect is related to air being forced to flow from between brush elements hitting a surface to be cleaned and air being sucked in between the brush elements again after the brush elements have left the surface. In other words, an air-pumping effect of the brush is obtained in view of the fact that the brush is locally compressed at the position of contact to a surface to be cleaned and locally opens up at a position of having passed the position of contact. It appears that this air-pumping effect is reduced when the packing density of the brush elements is reduced, and that as an advantageous consequence, the amount of energy needed for moving the brush can be reduced. Further, the applicant has found that it is possible to reduce the packing density of the brush elements to a significant extent and still obtain acceptable cleaning results.

In the context of the invention, it has been found that a combination of acceptable cleaning results and relatively low consumption of energy for driving the brush is realized when the average of the packing density of the brush elements in the bristle field is lower than 15,000 brush elements per 1 $cm^2$. Other possible maximum values in respect of the average of the packing density of the brush elements in the bristle field are 10,000 brush elements, 5,000 brush elements, 3,000 brush elements or 2,000 brush elements per 1 $cm^2$.

The bristle field of the brush is the entirety of an area of the brush where brush elements are present, wherein, in the direction of the longitudinal axis of the brush, the bristle field extends between edge brush elements at a first longitudinal position in the brush and edge brush elements at another, second longitudinal position in the brush. It is practical if the bristle field spans the entire periphery of the brush, but that does not alter the fact that it is also possible that the bristle field spans only a part of the periphery of the brush. The invention covers both options of the brush elements being substantially equally distributed throughout the bristle field and the brush elements being unequally distributed throughout the bristle field. In the context of the second option, it may be practical if the bristle field comprises local interruptions, i.e. is locally free from bristle elements.

In the framework of the invention, it is possible that the packing density of the brush elements is practically the same throughout the brush. On the other hand, it may be beneficial if there is a certain distribution of the packing density along the brush. For example, it may be so that the packing density of the brush elements is higher at the position of an intermediate section of the bristle field than at the position of two side sections of the bristle field which are located at either side of the intermediate section. The applicant has found that it is possible to achieve even further reduced energy consumption on the one hand and still acceptable cleaning results on the other hand when the brush is designed with different packing densities of the brush elements in different sections of the bristle field, in the direction of the longitudinal axis of the brush. When such a brush is used in a process of cleaning a surface, the further reduction of energy consumption results from reduced interaction between the brush and the surface at the position of the side sections of the bristle field, wherein the cleaning performance of the brush is mainly determined on the basis of the higher packing density of the brush elements at the position of the intermediate section of the bristle field.

In a practical embodiment of the above-mentioned brush, the intermediate section of the bristle field has a central position in the brush, as seen in the direction of the longitudinal axis of the brush. Especially in a context of a cleaning device comprising at least one brush arranged at a central position in a functional head thereof, such positioning of the intermediate section of the bristle field contributes to achieving the acceptable cleaning results as envisaged because it is natural behavior of a user of such a cleaning device to pass a central section of the functional head over visible stains etc.

It is noted that it may be so that the bristle field is composed of no more than the intermediate section and the two side sections, in which case the two side sections are in fact two end sections of the bristle field. On the other hand, it is another feasible option that more sections can be discerned in the bristle field. The fact is that the invention covers all options in which the bristle field includes an intermediate section at the position of which brush elements are arranged at a relatively high packing density, sandwiched between two side sections at the position of which brush elements are arranged at lower packing densities. The packing density of the brush elements at the position of one of the two side sections of the bristle field may be the same as the packing density of the brush elements at the position of the other of the two side sections of the bristle field, but this is not essential in the framework of the invention.

In the context of the invention, any suitable relation between the packing density of the brush elements at the position of each of the two side sections of the bristle field and the packing density of the brush elements at the position of the intermediate section of the bristle field may be chosen. For example, it may be so that the packing density of the brush elements at the position of each of the two side sections of the bristle field is at most 50% of the packing density of the brush elements at the position of the intermediate section of the bristle field.

The brush elements can be arranged in a pattern of tufts, in which case a reduced average of the packing density of brush elements in the bristle field may be obtained by having less brush elements per tuft and/or less tufts per area of predetermined size as compared to conventional brushes. In respect of the number of brush elements per tuft, it is noted that this may be as much as 300 or more, 500 or more, or 1,000 or more.

In a practical embodiment, the brush is generally shaped like an elongated cylinder having a circular periphery, wherein it is noted that the invention is not restricted to this particular configuration and shape of the brush. Also, it may be practical if the brush comprises a cloth which is provided with the brush elements and which is wrapped around the core element. In case the brush comprises the different sections of different packing density of the brush elements in the bristle field, one cloth with appropriate different sections may be provided or different cloths for each of the different sections of the bristle field may be used.

Advantageously, a material used in the brush elements is a microfiber material. Practical examples of such a material include a polyester microfiber, a polyamide microfiber and a polypropylene microfiber. According to a feasible option, the brush elements are made of a single type of microfiber material. The brush according to the invention may be especially configured for use in wet cleaning actions, and the optional microfiber material of the brush elements renders the brush suitable for such use.

The invention also provides a cleaning device which is movable across surfaces for cleaning the surfaces, which comprises a functional head configured to face the surfaces to be cleaned and at least one brush as defined in the foregoing, the brush being rotatably arranged in the functional head about a rotational axis extending in the direction of the longitudinal axis of the brush. In the cleaning device according to the invention, the at least one brush serves to actually interact with the surfaces to be cleaned during operation of the cleaning device. It is noted that it is practical if the brush is shaped more or less like roller having a circular cross-section. It may be beneficial if the cleaning device is provided with a driving mechanism which is configured to drive the at least one brush at a rotation speed involving acceleration including centrifugal acceleration of at least 3,500 $m/s^2$ at tip portions of the brush elements moving out of contact with a surface to be cleaned during operation of the cleaning device, in conformity with what has been suggested earlier in this respect. Depending on factors including the dimensioning of an actual brush according to the invention, this may imply that it may be beneficial if the cleaning device is provided with a driving mechanism which is configured to drive the at least one brush at a rotation speed of at least 4,500 rpm, or of at least 6,500 rpm or an even higher value, which does not alter the fact that other possibilities in respect of the rotation speed are covered by the invention as well.

The invention is especially applicable to cleaning devices which are operable in one of a dry operation mode and a wet operation mode, and cleaning devices which are operable in a wet operation mode only. It is practical for a cleaning device which is operable in a wet operation mode as possible operation mode besides a dry operation mode or as only possible operation mode to comprise a wetting system configured to supply a cleaning liquid to an area of the functional head where the at least one brush is located to thereby realize a wet cleaning condition of the at least one brush in the wet operation mode of the cleaning device. The wetting system as mentioned may particularly be configured to supply a cleaning liquid such as water or a water/soap mixture to the area of the functional head where the at least one brush is located, and may be designed to realize a wet cleaning condition of the at least one brush in either a direct manner or an indirect manner, i.e. either by spraying liquid directly on the at least one brush, for example, or by spraying liquid on an area of the surface to be cleaned which is covered by the at least one brush so that the at least one brush is wetted under the influence of contact to that area of the surface to be cleaned. Further, the wetting system as mentioned may include a pump arrangement configured to supply the cleaning liquid to the area of the functional head where the at least one brush is located by pumping the cleaning liquid towards that area.

In respect of the possibility of using a cleaning liquid in the cleaning device according to the invention, it is noted that it may be practical if the cleaning device comprises a reservoir configured to contain the cleaning liquid to be supplied to the area of the functional head where the at least one brush is located by means of the wetting system. In any case, it may be practical if the cleaning device comprises a collection area and a conveying area, wherein dirt and/or liquid from the at least one brush reaches the collection area through the conveying area during operation. The conveying area may simply include a transport pipe, for example, and conveyance of the dirt and/or liquid may take place under the influence of an airflow, in which case the cleaning device may be provided with a vacuum mechanism for inducing the airflow.

The cleaning device may further comprise a controlling system configured to control operation of the cleaning device according to an operation program, wherein the controlling system may comprise a microcontroller or the like having a memory in which the operation program is stored. The cleaning device may be equipped with a user interface for allowing a user of the cleaning device to influence the way in which the cleaning device is operated by addressing one or more particular algorithms of the operation program and/or temporarily overruling the operation program.

It is to be noted that the concept of having different sections of different packing density of the brush elements in the bristle field as described in the foregoing, particularly at least an intermediate section and two side sections of the bristle field, may be put to practice independently from the concept of having a linear mass density of at least the tip portions of the brush elements which is lower than 15 g per km and having an average of a packing density of the brush elements in the bristle field which is lower than 15,000 brush elements per 1 $cm^2$. Hence, in another aspect, the invention can be defined as relating to a brush configured for use in a cleaning device which is movable across surfaces for cleaning the surfaces, comprising a core element and brush elements arranged on the core element, wherein tip portions of the brush elements are configured to contact the surfaces to be cleaned, wherein the brush elements are arranged in a bristle field extending in a direction of a longitudinal axis of the brush and in a peripheral direction about the longitudinal axis, and wherein a packing density of the brush elements is higher at the position of an intermediate section of the bristle field than at the position of two side sections of the bristle field which are located at either side of the intermediate section of the bristle field.

Factors discussed in the foregoing are equally applicable to the above-mentioned other aspect of the invention, including the following: i) the brush elements comprise fiber hairs, wherein a linear mass density of at least the tip portions of the brush elements is lower than 15 g per 10 km, or even lower than 10 g per 10 km, 5 g per 10 km or 1 g per 10 km, ii) the intermediate section of the bristle field has a central position in the brush, as seen in the direction of the longitudinal axis of the brush, iii) the brush elements are either substantially equally distributed throughout the bristle field or unequally distributed throughout the bristle field, wherein when the brush elements are unequally distributed throughout the bristle field, the bristle field may comprise local interruptions, iv) the bristle field comprises a pattern of tufts of the brush elements, wherein a number of brush elements per tuft may be at least 300, or at least 500, or at least 1,000, v) the brush is generally shaped like an elongated cylinder having a circular periphery, vi) the brush comprises a cloth which is provided with the brush elements and which is wrapped around the core element, and vii) the brush elements comprise a microfiber material. Further options include viii) the packing density of the brush elements at the position of one of the two side sections of the bristle field is the same as the packing density of the brush elements at the position of the other of the two side sections of the bristle field, and ix) the packing density of the brush elements at the position of each of the two side sections of the bristle field is at most 50% of the packing density of the brush elements at the position of the intermediate section of the bristle field. Also, the brush is suitable to be used in a cleaning device which is movable across surfaces for cleaning the surfaces. Thus, in the other aspect, the invention also relates to a cleaning device comprising a functional head configured to face the surfaces to be cleaned during operation of the cleaning device and at least one of such a brush arranged in the functional head. The further options discussed in the foregoing with in respect of a cleaning device comprising at least one brush are equally applicable.

The above-described and other aspects of the invention will be apparent from and elucidated with reference to the following detailed description of an embodiment of a cleaning device and embodiments of a brush for use in the cleaning device.

BRIEF DESCRIPTION OF THE DRAWINGS

The invention will now be explained in greater detail with reference to the figures, in which equal or similar parts are indicated by the same reference signs, and in which:

FIG. 1 diagrammatically shows components of a wet cleaning device according to an embodiment of the invention and a portion of a floor having a surface to be cleaned;

FIG. 2 diagrammatically shows a perspective view of a portion of a brush according to a first embodiment of the invention;

DETAILED DESCRIPTION OF EMBODIMENTS

Figure 3:
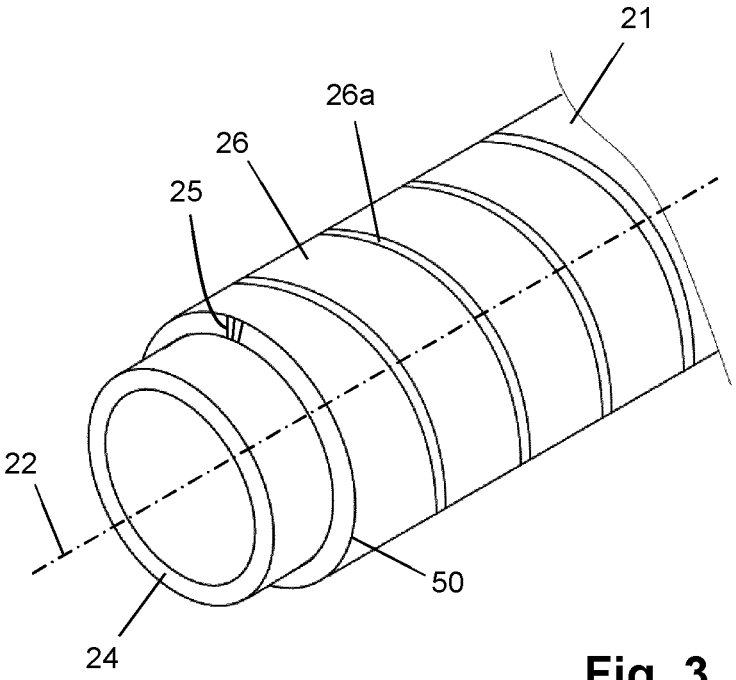
FIG. 3 diagrammatically shows a perspective view of a portion of a brush according to a second embodiment of the invention.

FIG. 1 illustrates the design of a wet cleaning device 1 according to an embodiment of the invention. The particular cleaning device represented in FIG. 1 and described in the following is just one example of many types of cleaning devices which are feasible in the framework of the invention. In this respect, it is noted that the invention does not only relate to wet cleaning devices, but also to other types of cleaning devices such as wet/dry cleaning devices having a dry cleaning function besides a wet cleaning function, and vacuum cleaners having a vacuum cleaning function besides a wet cleaning function and possibly also a dry cleaning function.

The wet cleaning device 1 is configured to be used for the purpose of subjecting a surface such as a floor surface to a wet cleaning action. At a side that is supposed to face the surface 10 during operation of the cleaning device 1, the cleaning device 1 comprises a cleaner nozzle 20 accommodating two brushes 21. In the following, it is assumed that each of the brushes 21 is provided in the form of a roller that is rotatable about a brush rotation axis 22 that is defined by a central longitudinal axis of the roller, which does not alter the fact that other embodiments of the brushes 21 are possible as well. As indicated in FIG. 1 by means of curved arrows depicted at the position of the brushes 21, the brushes 21 are arranged so as to be rotatable in opposite directions about their respective brush rotation axes 22. In the framework of the invention, the cleaner nozzle 20 may accommodate another number of brushes 21, wherein it is particularly to be noted that having just a single brush 21 is a feasible alternative option. The cleaner nozzle 20 comprises a brush holder frame 23 that serves for suspending the brushes 21. Besides the cleaner nozzle 20, the cleaning device 1 comprises a body portion 30 which is configured to be taken hold of by a user of the cleaning device 1 and that is connectable to the cleaner nozzle 20 through a hinge arrangement 31.

For the purpose of driving the brushes 21 during operation of the cleaning device 1, the cleaning device 1 is equipped with a suitable electric drive mechanism (not shown). For the purpose of powering the drive mechanism and probably also other components of the cleaning device 1, the cleaning device 1 may be connectable to the mains and/or may be equipped with a suitable battery arrangement. Preferably, the cleaning device 1 is a cordless device comprising a rechargeable battery arrangement, in which case it may further be practical if the cleaning device 1 is part of a set including a charging dock besides the cleaning device 1. Such a set may also include a flushing tray that can be used for the purpose of cleaning the brushes 21. In case the cleaning device 1 is not equipped with a battery, a simple dock that is without charging ability may be provided for receiving and holding the cleaning device 1.

The body portion 30 of the cleaning device 1 includes a first reservoir 32 that serves for containing a cleaning liquid, and a liquid supply mechanism 33 that serves for supplying the cleaning liquid to the brushes 21 during operation of the cleaning device 1, and that is positioned between the first reservoir 32 and the cleaner nozzle 20 to that end. The liquid supply mechanism 33 may comprise any suitable type of pump arrangement 34, for example. The body portion 30 of cleaning device 1 further includes a second reservoir 35 that serves for containing used, dirty cleaning liquid, and a conveying area 36 that serves for receiving a mixture of cleaning liquid and dirt from the brushes 21 and for conveying the mixture to the second reservoir 35, and that is at a position between the cleaner nozzle 20 and the second reservoir 35. The body portion 30 may also include a vacuum mechanism 37 configured to create underpressure that is useful to support transportation of dirt through the body portion 30, in a direction away from the brushes 21, for example.

Although this is not illustrated in FIG. 1, it is practical if the body portion 30 of the cleaning device 1 has a housing for accommodating at least the reservoirs 32, 35, the liquid supply mechanism 33, the vacuum mechanism 37 and possible other components of the cleaning device 1 such as the above-mentioned optional battery arrangement. The body portion 30 of the cleaning device 1 comprises a handle 38 so that the user can easily take hold of the body portion 30 and move the cleaning device 1 across the surface 10 to be cleaned as desired.

Basic aspects of how the wet cleaning device 1 is operated are as follows. During operation, the brushes 21 are driven so as to rotate and the liquid supply mechanism 33 is activated so as to supply the cleaning liquid to the brushes 21, as indicated in FIG. 1 by a downward arrow on the left, and to thereby cause the brushes 21 to be in a wet cleaning condition. An area of the surface 10 that is within reach of the brushes 21 is wetted by the brushes 21. Any stains as may be present on the area of the surface 10 are detached under the influence of the cleaning liquid and/or are scrubbed off by the brushes 21, and any dirt as may be present on the area of the surface 10 is removed along with the cleaning liquid that is conveyed to the second reservoir 35 and passes through the conveying area 36 in the process, as indicated in FIG. 1 by an upward arrow on the right. In particular, the brushes 21 include a core element and flexible brush elements extending from the core element, which brush elements have tip portions for contacting the surface 10. Dirt and liquid are picked up from the surface 10 by the tip portions of the brush elements and are flung away from the tip portions as the brush rotates and the tip portions move out of contact to the surface 10.

In the shown example, the cleaning device 1 is equipped with a user interface 41 including an on/off button. Assuming an off mode of the cleaning device 1, operation of the cleaning device 1 is initiated when the user depresses the on/off button. The cleaning device 1 comprises a controlling system 40 including a microcontroller that is programmed to put the brushes 21 in motion and to activate both the liquid supply mechanism 33 and the vacuum mechanism 37 in reaction to the user depressing the on/off button. When the user depresses the on/off button once again, the user causes the controlling system 40 to control the cleaning device 1 to stop operating through shutting down power supply to the various functional components of the cleaning device 1.

Figure 4:
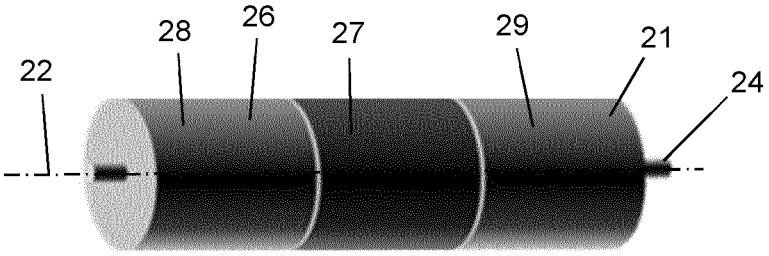
FIG. 4 diagrammatically shows a perspective view of a brush according to a third embodiment of the invention.

FIG. 2 serves to illustrate aspects of a brush 21 according to a first embodiment of the invention. As explained in the foregoing, the brush 21 includes a core element 24 and brush elements 25 arranged on the core element 24, wherein tip portions 25*a* of the brush elements 25 are configured to contact the surfaces 10 to be cleaned. For the sake of illustration, three brush elements 25 are diagrammatically depicted in FIG. 2, and an outer imaginary cylinder 50 of circular periphery delimiting an area around the core element 24 where the brush elements 25 are present is shown as well. The core element 24 can be of any suitable design, and may generally be shaped as a hollow cylinder, as shown in FIG. 2, or as a solid cylinder, as shown in FIG. 4, for example. The following features are applicable to the brush elements 25: i) the brush elements 25 are arranged in a bristle field 26 extending in a direction of the longitudinal axis 22 of the brush 21 and in a peripheral direction about the longitudinal axis 22, ii) the brush elements 25 comprise fiber hairs, wherein a linear mass density of at least the tip portions 25*a* of the brush elements 25 is lower than 15 g per 10 km, and iii) an average of a packing density of the brush elements 25 in the bristle field 26 is lower than 15,000 brush elements 25 per 1 $cm^2$.

As mentioned, an average of a packing density of the brush elements 25 in the bristle field 26 is lower than 15,000 brush elements 25 per 1 $cm^2$. A minimum of the average of the packing density of the brush elements 25 in the bristle field 26 may be applicable as well, such as a minimum of 1,000 per 1 $cm^2$, a minimum of 2,000 per 1 $cm^2$, or a minimum of 5,000 per 1 $cm^2$, for example. This is generally applicable in the framework of the invention, independent of other factors. Further, as mentioned, a linear mass density of at least the tip portions 25*a* of the brush elements 25 is lower than 15 g per 10 km. A minimum of the linear mass density of at least the tip portions 25*a* of the brush elements may be applicable as well, such as a minimum of 0.7 g per 10 km, a minimum of 0.8 per 10 km, or a minimum of 1 g per 10 km, for example. This is also generally applicable in the framework of the invention, independent of other factors. An example of an outer diameter of the core element 24 is a diameter in an order of magnitude of 20 mm, and an example of a diameter of the outer imaginary cylinder 50, i.e. a diameter of the brush 21 at an outstretched condition of the brush elements 25, is a diameter in an order of magnitude of 40 mm. In such a case, a length of the brush elements 25 is in an order of magnitude of 10 mm.

Compared to what is known in the art, the average of the packing density of the brush elements 25 in the bristle field 26 of lower than 15,000 brush elements 25 per 1 $cm^2$ is low and involves a reduction of consumption of energy for driving the brush 21.

FIG. 3 serves to illustrate aspects of a brush 21 according to a second embodiment of the invention. In the first place, it is noted that the size of the bristle field 26 in the direction of the longitudinal axis 22 of the brush 21 may be the same as the size of the core element 24 in the direction of the longitudinal axis 22 of the brush 21, but that it is also possible that the size of the bristle field 26 in the direction of the longitudinal axis 22 of the brush 21 is smaller than the size of the core element 24 in the direction of the longitudinal axis 22 of the brush 21. The latter is applicable to the brush 21 according to the second embodiment of the invention, and also to the brush 21 according to the third embodiment of the invention as will be described later with reference to FIG. 4. In the second place, it is noted that the brush elements 25 may be substantially equally distributed throughout the bristle field 26, but that it is also possible that the brush elements 25 are unequally distributed throughout the bristle field 26. The latter is the case in the brush 21 according to the second embodiment of the invention, wherein it is so that the bristle field 26 comprises local interruptions. In the shown example, a spiral-shaped strip portion 26*a* of the bristle field 26 is empty as compared to a continuous, even bristle field 26. For the sake of clarity, it is noted that in the definition of the invention, the local interruptions 26*a* are regarded as being included in the bristle field 26. This implies that when a bristle field 26 comprising local interruptions 26*a* is compared to a continuous bristle field 26, a total area of both bristle fields is the same if a longitudinal distance between edge brush elements 25 at a first longitudinal position in the brush 21 and edge brush elements 25 at another, second longitudinal position in the brush 21 is the same and if an extent to which the bristle field 26 spans the periphery of the brush 21 (which may be expected to be a full extent in many practical embodiments of the brush 21) is the same.

FIG. 4 shows a brush 21 according to a third embodiment of the invention which may comply with at least one of the above-mentioned numerical criteria in respect of the linear mass density of at least the tip portions 25*a* of the brush elements 25 and the average of the packing density of the brush elements 25 in the bristle field 26, although this is not necessary. FIG. 4 relates to an additional or alternative energy saving measure, and particularly illustrates the fact that in the direction of the longitudinal axis 22 of the brush 21, three different sections 27, 28, 29 of the bristle field 26 can be discerned. In respect of these sections 27, 28, 29 of the bristle field 26, it is noted that a packing density of the brush elements 25 is higher at the position of an intermediate section 27 of the bristle field 26 than at the position of two side sections 28, 29 of the bristle field 26 and which are located at either side of the intermediate section 27. In this way, good dirt and/or liquid removal performance of the brush 21 is obtained while it takes less energy to move the brush 21 over the surface 10 than if the packing density of the brush elements 25 in the bristle field 26 would not be reduced at the position of the two side sections 28, 29 of the bristle field 26. In particular, interaction between the brush 21 and the surface 10 at the position of the intermediate section 27 of the bristle field 26 contributes more to dirt and/or liquid removal performance of the brush 21 than interaction between the brush 21 and the surface 10 at the position of the side sections 28, 29 of the bristle field 26, and interaction between the brush 21 and the surface 10 at the position of the side sections 28, 29 of the bristle field 26 requires less energy than interaction between the brush 21 and the surface 10 at the position of the intermediate section 27 of the bristle field 26.

Figure 5:
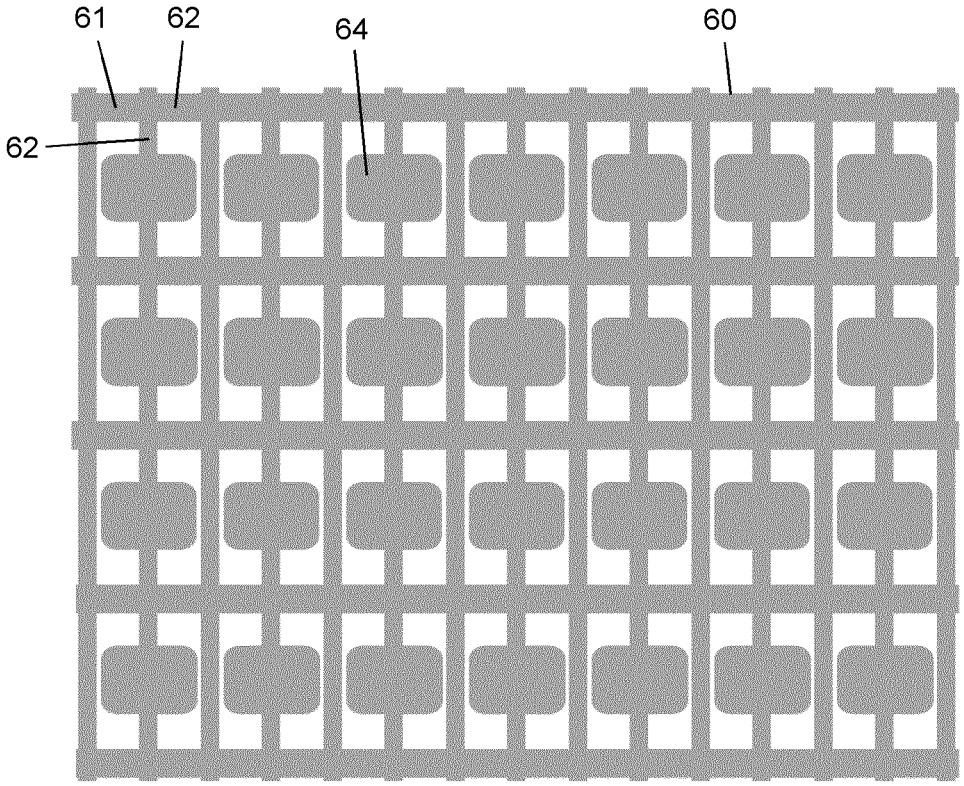
FIG. 5 diagrammatically shows a back side of a portion of a cloth provided with brush elements.
Figure 6:
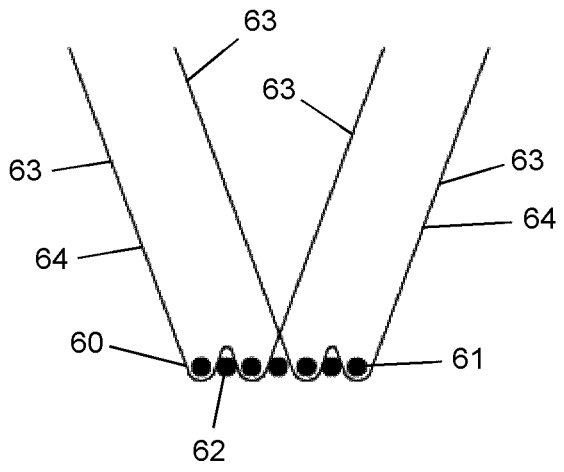
FIG. 6 illustrates how tufts of the brush elements are arranged on a backing of the cloth shown in FIG. 5.

With reference to FIGS. 5 and 6, it is noted that it may be practical if the brush 21 comprises a cloth which is provided with the brush elements 25 and which is wrapped around the core element 24. FIG. 5 shows a back side of a portion of an example of a cloth 60 as mentioned. The cloth 60 comprises a backing 61 including a carrier grid of strands 62, wherein tufts 63 of the brush elements are provided on the backing 61 by means of yarns 64 which are interwoven with the strands 62 of the backing 61. FIG. 6 illustrates that by way of example, each yarn 64 is interwoven with three strands 62 in a W-shaped fashion, wherein one outside leg of the W-shaped yarn 64 constitutes a first tuft 63 of brush elements 25, and wherein the other outside leg of the W-shaped yarn 64 constitutes a second tuft 63 of brush elements 25. Each tuft 63 includes a plurality of brush elements 25, wherein the number of brush elements 25 per tuft 63 may be in an order of hundreds of brush elements 25, or even 1,000 brush elements 25 or more.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

Notable aspects of the invention are summarized as follows. A brush 21 is configured for use in a cleaning device 1 which is movable across surfaces 10 to be cleaned and comprises a core element 24 and brush elements 25 arranged on the core element 24. The brush elements 25 are arranged in a bristle field 26 extending in a direction of a longitudinal axis 22 of the brush 21 and in a peripheral direction about the longitudinal axis 22, and comprise fiber hairs, wherein a linear mass density of at least tip portions 25*a* of the brush elements 25 is lower than 15 g per 10 km. An average of a packing density of the brush elements 25 in the bristle field 26 is lower than 15,000 brush elements 25 per 1 $cm^2$ so as to ensure that for the purpose of moving the brush 21 during a cleaning action, only a relatively small amount of energy is needed.

The invention claimed is:

1. A brush configured to be rotatably arranged in a cleaning device which is movable across surfaces for cleaning the surfaces, at the position of a functional head of the cleaning device which is configured to face the surfaces to be cleaned, the brush comprising a core element and brush elements arranged on the core element, wherein tip portions of the brush elements are configured to contact the surfaces to be cleaned, wherein the brush elements are arranged in a bristle field extending in a direction of a longitudinal axis of the brush and in a peripheral direction about the longitudinal axis, wherein the brush elements comprise fiber hairs, wherein a linear mass density of at least the tip portions of the brush elements is lower than 15 g per 10 km, and wherein an average of a packing density of the brush elements in the bristle field is lower than 15,000 brush elements per 1 $cm^2$, wherein the brush is configured with different packing densities of the brush elements in different sections of the bristle field, in the direction of the longitudinal axis of the brush wherein the packing density of the brush elements is higher at a position of an intermediate section of the bristle field than at a position of two side sections of the bristle field, wherein the side sections are located at either side of the intermediate section.

2. The brush of claim 1, wherein the brush elements are either substantially equally distributed or unequally distributed throughout the bristle field.

3. The brush of claim 2, wherein the brush elements are unequally distributed throughout the bristle field, and wherein the bristle field comprises local interruptions.

4. The brush of claim 1, wherein the average of the packing density of the brush elements in the bristle field is lower than 10,000 brush elements per 1 $cm^2$.

5. The brush of claim 1, wherein the linear mass density of at least the tip portions of the brush elements is lower than 10 g per 10 km.

6. The brush of claim 1, wherein the average of the packing density of the brush elements in the bristle field is higher than 1,000 brush elements per 1 $cm^2$.

7. The brush of claim 1, wherein the linear mass density of at least the tip portions of the brush elements is higher than 0.7 g per 10 km.

8. The brush of claim 1, wherein the bristle field comprises a pattern of tufts of the brush elements, and wherein a number of brush elements per tuft is at least 300.

9. The brush of claim 1, wherein the brush is shaped like an elongated cylinder having a circular periphery.

10. The brush of claim 1, wherein the brush comprises a cloth which is provided with the brush elements and which is wrapped around the core element.

11. The brush of claim 1, wherein the brush is configured to be driven at a rotation speed involving acceleration including centrifugal acceleration of at least 3,500 $m/s^2$ at tip portions of the brush elements moving out of contact with a surface to be cleaned during operation of the cleaning device.

12. A cleaning device which is movable across surfaces for cleaning the surfaces, comprising a functional head configured to face the surfaces to be cleaned and at least one brush of claim 1 rotatably arranged in the functional head about a rotation axis extending in the direction of the longitudinal axis of the brush.

13. The cleaning device of claim 12, wherein the cleaning device comprises a mechanism configured to drive the at least one brush at a rotation speed involving acceleration including centrifugal acceleration of at least 3,500 $m/s^2$ at tip portions of the brush elements moving out of contact with a surface to be cleaned during operation of the cleaning device.

14. The cleaning device of claim 12, wherein the cleaning device is operable in at least a wet operation mode and comprising a wetting system configured to supply a cleaning liquid to an area of the functional head where the at least one brush is located to thereby realize a wet cleaning condition of the at least one brush in the wet operation mode of the cleaning device.

15. The cleaning device of claim 14, wherein the wetting system comprises a pump arrangement configured to supply the cleaning liquid to the area of the functional head where the at least one brush is located, by pumping the cleaning liquid towards the area of the functional head.

16. The brush of claim 1, wherein the packing density of the brush elements at the position of each of the two side sections of the bristle field is at most 50% of the packing density of the brush elements at the position of the intermediate section of the bristle field.

17. The brush of claim 1, wherein the average of the packing density of the brush elements in the bristle field is higher than 2,000 brush elements per 1 $cm^2$.

18. The brush of claim 1, wherein the linear mass density of at least the tip portions of the brush elements is higher than 0.8 g per 10 km.

* * * * *